US005628404A

United States Patent [19]

Hendrix

[11] Patent Number: 5,628,404

[45] Date of Patent: May 13, 1997

[54] PORTABLE SELF-CONTAINED VACUUM PACKING DEVICE

[76] Inventor: Glen Hendrix, 1503 Auline La., Houston, Tex. 77055

[21] Appl. No.: 699,541

[22] Filed: Aug. 19, 1996

[51] Int. Cl.[6] ..... B65B 31/02

[52] U.S. Cl. ..... 206/524.8

[58] Field of Search ..... 206/524.8; 99/472; 141/65

[56] References Cited

U.S. PATENT DOCUMENTS 4,018,253 4/1977 Kaufman ..... 206/524.8 X 5,009,318 4/1991 Lepinoy ..... 206/524.8

*Primary Examiner*—Jacob K. Ackun

*Attorney, Agent, or Firm*—Harrison & Egbert

[57] ABSTRACT

A packing device including an outer flexible container having an opening formed therein, an inner flexible container having an opening formed therein and affixed to an interior of the outer flexible container, a first one-way valve affixed to the outer flexible container for allowing air to pass into the interior of the outer flexible container and exterior of the inner flexible container, and a second one-way valve interactive with the inner flexible container for allowing air to pass outwardly of an interior of the inner flexible container. The inner flexible container opens at the opening of the outer flexible container. A compression of the exterior of the outer flexible container causes the inner flexible container to expel air outwardly of the second one-way valve and to seal the inner flexible container around items on the interior of the inner flexible container.

20 Claims, 3 Drawing Sheets

PORTABLE SELF-CONTAINED VACUUM PACKING DEVICE

TECHNICAL FIELD

The present invention relates to packing devices. More particularly, the present invention relates to devices for retaining perishable products in a vacuum-packed environment. More particularly, the present invention relates to storage vessels which allow for the evacuation of air from an interior of the storage vessel.

BACKGROUND ART

There are in existence numerous devices for evacuating jars and other vessels containing perishable foodstuffs and for thereafter maintaining vacuum pressure within the vessel. Insofar as home canning apparatus is concerned, such devices have been employed in household use for the repeated exhaustion of air from jars after an initial opening of the jars and a consumption of the partial contents. Such devices also have been employed for the repeated evacuation of air from factory sealed jars and to other containers which are purchased on the market for household use. The withdrawal of air from a jar after each use greatly enhances the life of the remaining contents, whether the contents be factory or home sealed.

In the past, various patents have issued on devices for evacuating air from the interior of containers. For example, U.S. Pat. No. 2,916,173, issued on Dec. 8, 1959, to K. A. Klingler, U.S. Pat. No. 5,406,992, issued on Apr. 18, 1995, to E. J. Miramon, and U.S. Pat. No. 5,469,979, issued on Nov. 28, 1995 to W. N. Chiou describes various lids for containers. These lids have hand-actuated evacuation pumps.

U.S. Pat. No. 4,337,804, issued on Jul. 6, 1982, to R. M. Maruscak and U.S. Pat. No. 5,491,957, issued on Feb. 20, 1996 to R. Maskell teach the concept of collapsing flexible bags by evacuating the bag around the contents of the bag. Each of these devices describes the use of a vacuum probe for the purpose of bleeding air from the interior of the bag.

U.S. Pat. No. 3,414,160, issued on Dec. 3, 1968 to M. Weber, U.S. Pat. No. 3,672,114, issued on Jun. 27, 1972 to A. H. Sacks and U.S. Pat. No. 4,142,645, issued on Mar. 6, 1979 to D. G. Walton teach various evacuating vessels with various forms of valves. In general, all of these prior art patented devices describe affective ways for removing air from the interior of bags and bottles. However, in virtually all of the instances of these prior art patents, the evacuation devices are relatively expensive and difficult to use.

It is an object of the present invention to provide a device which allows for the vacuum packing of perishable items.

It is another object of the present invention to provide a packing device that is pump free.

It is a further object of the present invention to provide a packing device that creates a double-contained environment for the perishable contents.

It is a further object of the present invention to provide a packing device which is easy to use, relatively inexpensive, and easy to manufacture.

These and other objects and advantages of the present invention will become apparent from a reading of the attached specification and appended claims.

SUMMARY OF THE INVENTION

The present invention is a packing device that comprises an outer flexible container having an opening formed therein, an inner flexible container having an opening formed therein and affixed to an interior of the outer flexible container, a first one-way valve affixed to the outer flexible container for allowing air to pass into the interior of the outer flexible container and exterior of the inner flexible container, and a second one-way valve interactive with the inner flexible container for allowing air to pass outwardly of an interior of the inner flexible container. The opening of the inner flexible container is affixed to the opening of the outer flexible container such that the inner flexible container opens at the opening of the outer flexible container.

In one embodiment device of the present invention, the second one-way valve is affixed to a cap attached to the opening of the outer flexible container. The cap serves to cover the inner flexible container. The first one-way valve is affixed to a bottom of the outer flexible container. The outer flexible container is a bottle formed of a polymeric material. The first one-way valve is affixed to a surface of the bottle. The cap is affixed over the opening of the bottle. The second one-way valve is affixed to the cap. The cap detachably covers the opening of the bottle and opens to the inner flexible container. The inner flexible container is a pouch having the opening sealed around the interior of the opening of the outer flexible container. The pouch has an inner volume for storing items therein.

The cap as used in this embodiment of the present invention includes a hole formed therethrough. The second one-way valve includes an elastomeric member covering the hole in the cap. The elastomeric member has a surface affixed to the cap. The membrane is movable between a first position and a second position. The first position is separated from the hole so as to allow air to pass therethrough. The second position is juxtaposed against and over the hole so as to resist air passage through the hole. A filter is affixed to an underside of the cap and over the hole. This filter serves to resist a passage of non-gaseous material through the hole.

In another embodiment of the present invention, the outer flexible container is an outer pouch and the inner flexible container is an inner pouch. The inner pouch has an opening sealed within the opening of the outer pouch. A closure means is formed at the opening of the outer pouch so as to form an air-tight seal at the opening of the pouch. The outer pouch has a tab member affixed to a surface thereof and evacuating outwardly therefrom. The outer pouch has at least one stiffener strip extending across a surface of the outer pouch. The first one-way valve is formed on a surface of the outer pouch. This first one-way valve causes air to enter a volume between the inner surface of the outer pouch and an outer surface of the inner pouch. The inner pouch has a contiguous surface with the outer pouch. The second one-way valve is affixed to this contiguous surface for passing air outwardly of the inner pouch. The second one-way valve is affixed to the contiguous surface so as to prevent air from passing outwardly of the outer pouch.

DETAILED DESCRIPTION OF THE INVENTION

Figure 1:
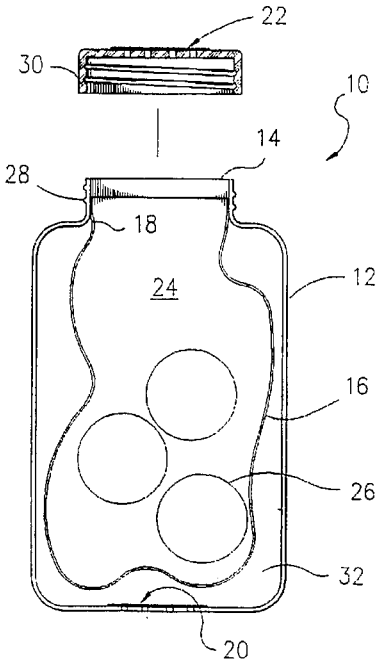
FIG. 1 is a cross-sectional, partially exploded view of the preferred embodiment of the present invention.

Referring to FIG. 1, there is shown at 10 the packing device in accordance with the preferred embodiment of the present invention. The packing device 10 includes an outer flexible container 12 having an opening 14 formed therein, an inner flexible container 16 having an opening 18 formed therein, a first one-way valve 20 affixed to the outer flexible container 12, and a second one-way valve 22 interactive with the inner flexible container 16. The first one-way valve 20 allows air to pass into the interior of the outer flexible container 12 and exterior of the inner flexible container 16. The second one-way valve 22 allows air to pass outwardly of the interior 24 of the inner flexible container 16. The interior 24 of the inner flexible container 16 has a volume suitable for receiving various items 26 therein. The items 26 can be, for example, perishable food items.

As can be seen in FIG. 1, the outer flexible container 12 is a bottle which is formed of a polymeric material. The bottle 12 can be formed of a plastic or other air impermeable material which can be repeatedly deformed and then regain its shape. The outer flexible container 12 has its opening 14 formed at one end. A threaded area 28 extends around the opening 14 so as to be in a suitable position for the receipt of a cap 30. The second one-way valve 22 is formed on a top surface of the cap 30. The cap 30 can be screwed onto the threaded area 28 at the opening 14 of the outer flexible container 12. As can be seen, the opening 18 of the inner flexible container 16 is sealed around the opening 14 of the outer flexible container 12. As such, when the cap 30 is removed, access to the interior 24 of the inner flexible container 16 is available.

The inner flexible container 16 is a thinner flexible pouch which is affixed onto the interior of the outer flexible container 12. The first one-way valve 20 is affixed to the bottom of the outer flexible container 12. The first one-way valve 20 allows air to enter the volume 32 between the inner wall of the outer flexible container 12 and the exterior surface of the inner flexible container 16.

Figure 2:
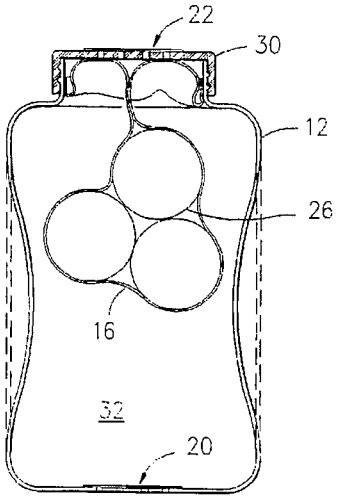
FIG. 2 is a cross-sectional view showing the operation of the preferred embodiment of the packing device of the present invention.

FIG. 2 shows the technique for the vacuum packing of items. In FIG. 2, it can be seen that the sides of the outer flexible container 12 can be squeezed inwardly. Since the one-way valve 20 only allows the passage of air into the interior 32 of the outer flexible container 12, the squeezing of the sides of the outer flexible container 12 will not cause air to pass outwardly of the valve 20. However, the squeezing of the outer flexible container 12 will cause the inner flexible container 16 to compress around the items 26. The air on the interior of the inner flexible container 16 will pass outwardly of the pouch 16 through the one-way valve 22 on the cap 30. Since the air cannot pass into the interior of the inner flexible container 16 through the one-way valve 22, the air on the interior of the inner flexible container 16 can only be evacuated through the one-way valve 22. As such, a compressing of the exterior of the outer flexible container 12 will cause the vacuum packing of the items 26 on the interior of the inner flexible container 16.

Figure 3:
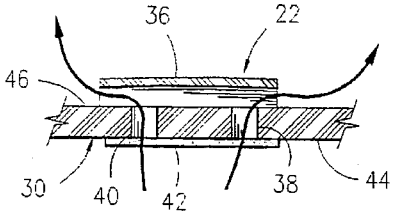
FIG. 3 is a cross-sectional view of the one-way valve used on the cap of the preferred embodiment of the present invention.

FIG. 3 shows a detailed view of the cap 30 which has the second one-way valve 22 formed therein. The second one-way valve 22 includes an elastomeric membrane 36 which extends over holes 38 and 40. Holes 38 and 40 extend through the thickness of the cap 30. A filter 42 is affixed to the inner surface 44 of the cap 30. Filter 42 serves to prevent small particles (such as coffee, flour, etc.) from passing outwardly of the cap 30.

The membrane 36 has a surface which is affixed to the top surface 46 of the cap 30. The elastomeric membrane 36 is movable between a first position (as shown in FIG. 3) which is separated from the holes 38 and 40 so as to allow air to pass outwardly therethrough. The membrane 36 can return to its original position juxtaposed against and over the holes 38 and 40 so as to prevent air from entering the interior of the inner flexible container 16. The arrows in FIG. 3 show the flow of air outwardly from the inner flexible container 16 through the cap 30. The elastomeric membrane 36 can be formed of a latex material. Although FIG. 3 shows a pair of holes 38 and 40, many holes can be used or a single hole can be used. Once the air is forced out of the inner flexible container 16, the membrane 36 covers the holes 38 and 40. Atmospheric pressure keeps the membrane 36 in place so as to form an airtight seal.

Figure 4:
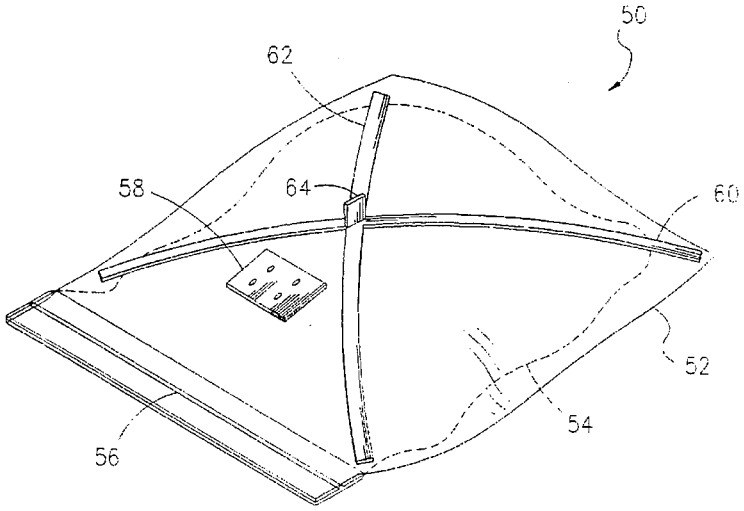
FIG. 4 is a perspective view of an alternative embodiment of the packing device of the present invention.

FIG. 4 shows an alternative embodiment 50 of the packing device of the present invention. The packing device 50 includes an outer pouch 52 and an inner pouch 54. The inner pouch 54 is illustrated in broken line fashion. A closure member 56 is formed at the opening of the outer pouch 52. As can be seen, the inner pouch 54 opens at the opening of the outer pouch 52. The inner pouch 54 is sealed to the opening of the outer pouch 52. The closure member 56, as used in the packing device 50, is a ZIPLOC (TM) closure. When this closure member 56 is opened, access can be gained to the interior of the inner pouch 54. A first one-way valve 58 is affixed to the outer pouch 52 so as to allow air to pass into the interior of the outer pouch 52 and to the exterior of the inner pouch 54. The first one-way valve 58 is formed on the surface of the outer pouch 52.

Stiffener members 60 and 62 extend in a cruciform manner across the outer surface of the outer pouch 52. Stiffener members 60 and 62 allow the outer pouch 52 to maintain a proper shape rather than collapsing under partial vacuum. A tab 64 is affixed to the outer surface of the outer pouch 52 so as to allow the proper manipulations of the outer pouch 52 for the purposes of vacuum packing.

Figure 5:
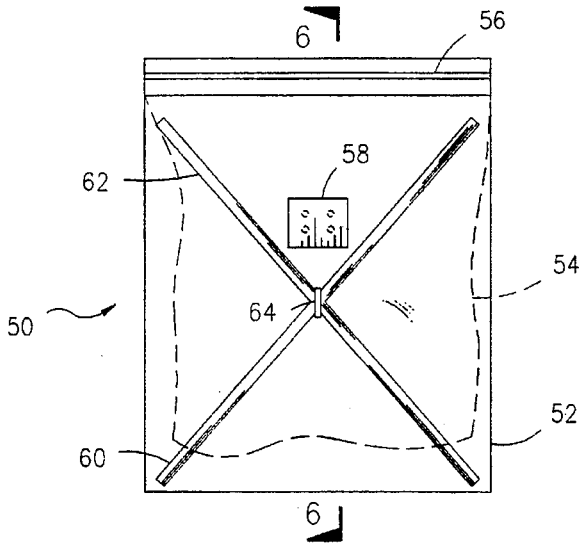
FIG. 5 is a plan view of the alternative embodiment of the packing device of the present invention.

FIG. 5 illustrates that the outer pouch 52 has a generally rectangular configuration. The stiffener members 60 and 62 extend diagonally across the surface of the outer pouch 52. The stiffener members 60 and 62 can be applied to both sides of the outer pouch 52. The inner pouch 54 resides within the interior of the outer pouch 52. The opening of the inner pouch 54 is sealed within the opening of the outer pouch 52.

Figure 6:
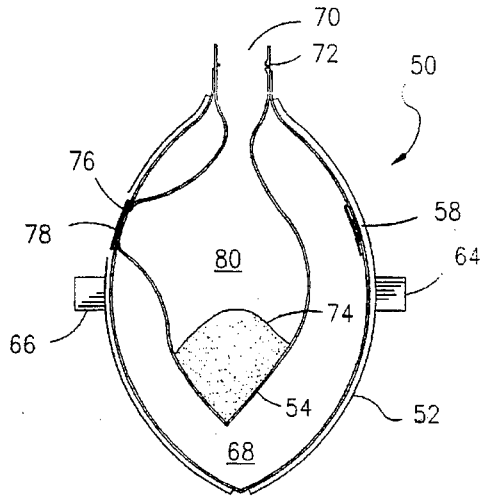
FIG. 6 is a cross-sectional view taken across lines 6—6 of FIG. 5.

FIG. 6 illustrates the interior of the packing device 50. As can be seen, the outer pouch 52 has tabs 64 and 66 extending outwardly from the sides. The first one-way valve 58 is affixed to the side of the outer pouch 52 so as to allow air to enter the volume 68 between the inner wall of the outer pouch 52 and the exterior surface of the inner pouch 54. It can be seen that the inner pouch 54 has its opening 70 sealed to the opening 72 of the outer pouch 52. As such, when the opening 72 of the outer pouch 52 is closed, the opening 70 of the inner pouch 54 will also be sealed. The inner pouch 54 can retain a perishable item 74 therein.

Importantly, a contiguous surface 76 is formed between the inner pouch 54 and the outer pouch 52. The contiguous surface 76 can receive the second one-way valve 78 therein. The second one-way valve 78 is affixed to the contiguous surface 76 so as to pass air outwardly of the interior of the inner pouch 54. When the tabs 64 and 66 are pulled outwardly, then air will be sucked into the interior volume 68 through the first one-way valve 58.

Figure 7:
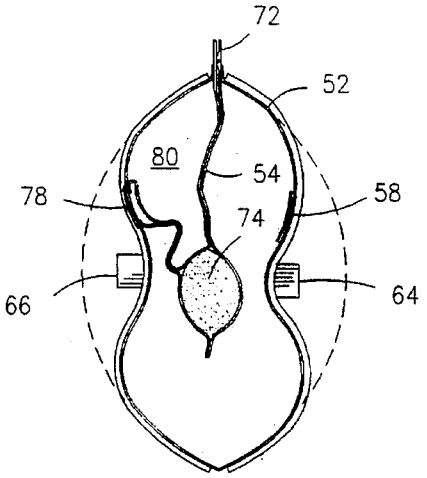
FIG. 7 is a cross-sectional view showing the operation of the packing device of the alternative embodiment of the present invention.

FIG. 7 shows how pressure can be applied to the outer pouch 52 so as to compress and to vacuum pack the contents 74 on the interior of the inner pouch 54. When pressure is applied to the tabs 64 and 66, the sides of the outer pouch 52 will be pushed toward one another. Such compressive action can occur when the opening 72 is properly sealed. This compression of the sides of the outer pouch 52 will cause air on the interior 80 of the inner pouch 54 to pass outwardly through the second one-way valve 78. As a result, the perishable item 74 can be effectively vacuum packed on the interior of the inner pouch 54.

Figure 8:
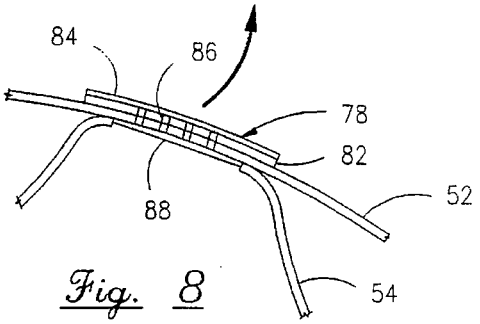
FIG. 8 is a detailed cross-sectional view of the operation of one of the valves of this alternative embodiment.

FIG. 8 shows the details of the check valve 78. One-way valve 78 includes a stiffener member 82 which forms a substrate for the valve 78. A membrane 84 is affixed over the substrate 82. As such, the membrane 84 will cover the holes 86 which are formed through the stiffener member 82 and through the wall of the outer pouch 52. A filter 88 can be affixed to the interior surface of the outer pouch 52 and over the holes 86 so as to prevent materials from inadvertently passing outwardly of the inner pouch 54. As can be seen, the inner pouch 54 is contiguous with the outer pouch 52 at the area of the one-way valve 78.

Figure 9:
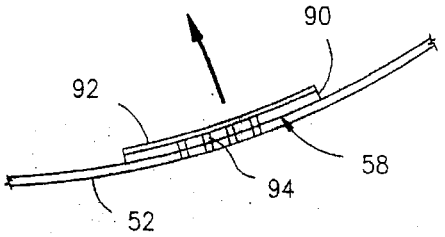
FIG. 9 is a cross-sectional detailed view of the operation of the other valve used in this alternative embodiment of the present invention.

FIG. 9 illustrates the operation of the one-way valve 58. As can be seen, one-way valve 58 includes a stiffener member 90 which extends over the outer surface of the outer pouch 52. A membrane 92 covers the holes 94. Holes 94 extend through the wall of the outer pouch 52 and through the stiffener member 90. The membrane 92, along with the stiffener member 90, is located on the interior wall of the outer pouch 52. As such, air can pass into the interior volume 68 through the holes 94 and through the membrane 92.

Figure 10:
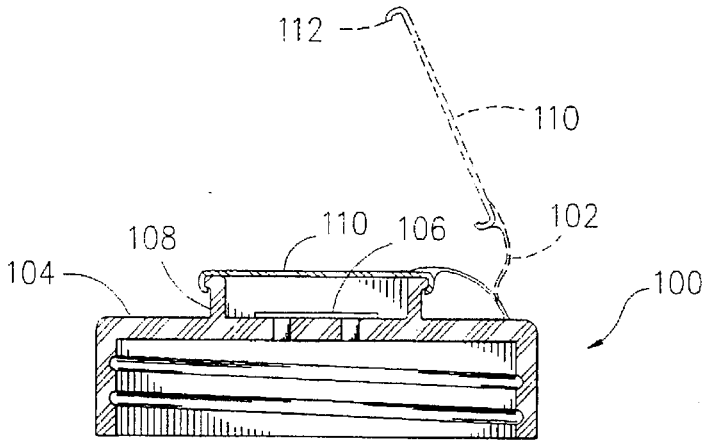
FIG. 10 is a detailed view of an alternative embodiment of the cap used on the preferred embodiment of the present invention.

FIG. 10 shows an alternative cap 100 for use on the outer flexible container 12 of FIGS. 1–3. In this embodiment, a closure member 102 is hingedly connected to a top surface 104 of the cap 100. The closure member 102 serves to sealingly cover the second one-way valve 106. The closure member 102 is movable between a first position which covers the second one-way valve 106 and a second position (shown in broken line fashion) which opens to the second one-way valve 106. In particular, the closure member 102 includes a receptacle 108 which is affixed to the cap 104 and extends around the second one-way valve 106. A lid 110 is hingedly connected to the cap 104. The lid 110 includes clamps 112 which are attachable to the receptacle 108 in a snap-fit relationship. When the lid 110 is snapped in place over the second one-way valve 106, long-term vacuum integrity can be assured.

Figure 11:
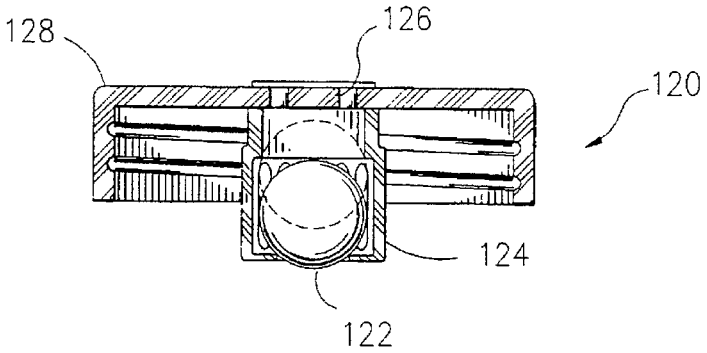
FIG. 11 is another alternative embodiment of the cap used on the preferred embodiment of the present invention alternative embodiment.

FIG. 11 shows another cap 120 which is suitable for use on the outer flexible container 12. The cap 120 includes a float 122 that is seated within valve. Float 122 is movable between a lower position (shown in solid lines) to an upper position (shown in broken line fashion) within the cage 124. The second one-way valve 126 is formed in the top surface 128 of the cap 120. The float 122 will ride upwardly in the cage 124 with the upward movement of liquids. As a result, it serves to prevent liquids from exiting through the one-way valve 126. The cage 124 retains the float 122 and serves as a seat for the movement of the float 122.

Figure 12:
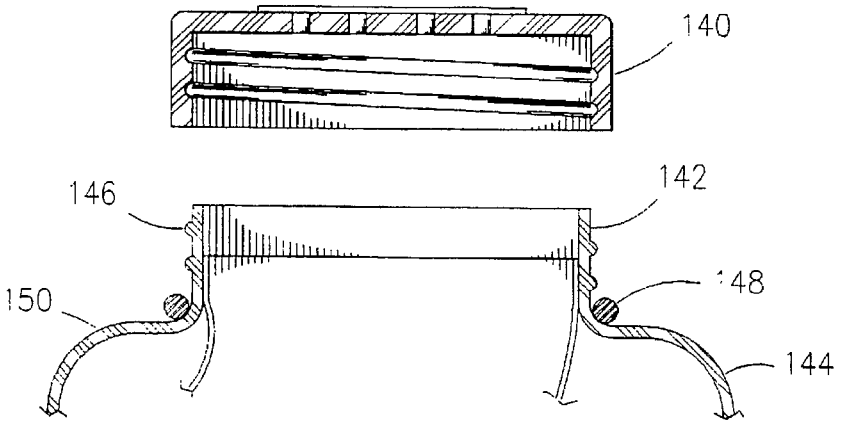
FIG. 12 is a further alternative embodiment of the cap used on the preferred embodiment of the present invention.

FIG. 12 shows a further arrangement in which the cap 140 can be sealed in air-tight relationship with the opening 142 of the outer flexible container 144. It can be seen that the opening 142 has threads 146 extending therearound. Threads 146 serve to receive the threaded interior of the cap 140. Importantly, an O-ring seal 148 is placed around the threaded area 146 of the container 144. The O-ring seal 148 provides a seal between the bottom portion of the cap 140 and the shoulder 150 of the container 144. As a result, the O-ring seal 148 will serve to further maintain the air-tight relationship between the cap 140 and the opening 142 of the container 144.

The present invention is very suitable for the storage of any item. The packing device of the present invention preserves perishable items for a long period of time. The packing device of the present invention prevents the perishable item from suffering the ravages of oxygen. Food and medicine are the primary items which are stored in the present invention. However, a large variety of other items could also be stored in the present invention. The present invention facilitates the ability to freeze dry items by placing the device in the freezer after storing a vacuum-packed item.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A packing device comprising:

an outer flexible container having an opening formed therein;

an inner flexible container having an opening formed therein, said inner flexible container being affixed to an interior of said outer flexible container;

a first one-way valve means affixed to said outer flexible container for allowing air to pass into the interior of said outer flexible container and exterior of said inner flexible container; and a second one-way valve means interactive with said inner flexible container for allowing air to pass outwardly of an interior of said inner flexible container.

2. The device of claim 1, said opening of said inner flexible container being affixed to said opening of said outer flexible container such that said inner flexible container opens at said opening of said outer flexible container.

3. The device of claim 2, said second one-way valve means being affixed to a cap attached to said opening of said outer flexible container, said cap covering said inner flexible container.

4. The device of claim 3, said first one-way valve means being affixed to a bottom of said outer flexible container.

5. The device of claim 1, said outer flexible container comprising:

a bottle formed of a polymeric material, said first one-way valve means affixed to a surface of said bottle; and a cap affixed over said opening of said bottle, said second one-way valve means affixed to said cap, said cap detachably covering said opening of said bottle and said opening of said inner flexible container.

6. The device of claim 1, said inner flexible container being a pouch having the opening sealed to said opening of said outer flexible container, said pouch having an inner volume for storing items therein.

7. The device of claim 5, said cap having a hole formed therethrough, said second one-way valve means comprising:

an elastomeric member covering said hole in said cap, said elastomeric member having a surface affixed to said cap, said membrane movable between a first position and a second position, said first position separated from said hole so as to allow air to pass therethrough, said second position juxtaposed against and over said hole so as to resist air passage through said hole.

8. The device of claim 7, said second one-way valve means further comprising:

a filter means affixed to an underside of said cap and over said hole, said filter means for resisting a passage of non-gaseous material through said hole.

9. The device of claim 1, said outer flexible container being an outer pouch, said inner flexible container being an inner pouch, said inner pouch having the opening sealed to said opening of said outer pouch, said outer flexible container further comprising:

a closure means formed at said opening of said outer pouch, said closure means for forming an air-tight seal at said opening of said outer pouch.

10. The device of claim 9, said outer pouch having a tab member affixed to a surface thereof and extending outwardly therefrom.

11. The device of claim 9, said outer pouch having at least one stiffener strip extending across a surface of said outer pouch.

12. The device of claim 1, said outer flexible container being an outer pouch, said inner flexible container being an inner pouch, said first one-way valve means formed on a surface of said outer pouch, said first one-way valve means for causing air to enter a volume between said inner surface of said outer pouch and an outer surface of said inner pouch.

13. The device of claim 12, said inner pouch having a contiguous surface with said outer pouch, said second one-way valve means affixed to said contiguous surface for passing air outwardly of said inner pouch.

14. The device of claim 13, said second one-way valve means affixed to said contiguous surface so as to prevent air from passing outwardly of said volume.

15. The device of claim 12, said first one-way valve means comprising:

a hole formed through a wall of said outer pouch;

a stiffener member affixed to said outer pouch so as to extend over said hole; and a membrane having a portion affixed to said outer pouch, said membrane extending over said hole, said membrane movable between a first position allowing air to pass inwardly through said hole and a second position resisting air flow outwardly through said hole.

16. The device of claim 5, said cap having a closure means hingedly connected therethrough, said closure means for sealingly covering said second one-way valve means, said closure means movable between a first position covering said second one-way valve means and a second position exposing said second one-way valve means.

17. The device of claim 16, said closure means comprising:

a receptacle member affixed to said cap and extending around said second one-way valve means; and a lid hingedly connected to said cap, said lid in snap-fit relationship with said receptacle member.

18. The device of claim 5, said cap having a float valve means formed therein, said float valve means for preventing liquids from flowing outwardly of said bottle through said second one-way valve means.

19. The device of claim 5, said bottle having a threaded area adjacent said opening, said cap being threadedly received on said threaded area of said bottle.

20. The device of claim 19, said bottle having an O-ring seal extending around said opening of said bottle at said threaded area, said O-ring seal forming an air-tight seal between said cap and said bottle.

* * * * *